US009488455B1

(12) United States Patent
Bzorgi

(10) Patent No.: US 9,488,455 B1
(45) Date of Patent: Nov. 8, 2016

(54) SABOT ASSEMBLY

(71) Applicant: Consolidated Nuclear Security, LLC, Reston, VA (US)

(72) Inventor: Fariborz Bzorgi, Knoxville, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 0 days.

(21) Appl. No.: 14/602,556

(22) Filed: Jan. 22, 2015

(51) Int. Cl.
*F42B 14/06* (2006.01)

(52) U.S. Cl.
CPC ..... *F42B 14/062* (2013.01); *F42B 14/06* (2013.01)

(58) Field of Classification Search
CPC ..... F42B 8/14; F42B 14/00; F42B 14/06; F42B 14/061; F42B 14/062; F42B 14/064; F42B 14/065; F42B 14/067; F42B 14/08; F42B 14/02; F42B 14/068
USPC ..... 102/520, 521, 522, 523, 525, 527, 528
See application file for complete search history.

(56) References Cited

U.S. PATENT DOCUMENTS 2,669,930 A * 2/1954 Darby ..... F42B 14/02 102/523
3,033,116 A * 5/1962 Critcher ..... F42B 14/061 102/521
3,311,061 A 3/1967 Roehrdanz
3,430,570 A 3/1969 Barr
3,446,147 A * 5/1969 Heinrich ..... F42B 14/064 102/522
3,620,167 A 11/1971 Romer et al.
3,927,618 A * 12/1975 Engel ..... F42B 14/064 102/522
4,142,467 A * 3/1979 Stahlmann ..... F42B 14/08 102/523
4,148,259 A 4/1979 Yuhash et al.
4,239,006 A 12/1980 Kelson
4,314,510 A * 2/1982 Jeter ..... F42B 14/064 102/521
4,411,200 A * 10/1983 Brede ..... F42B 8/14 102/377
H142 H * 10/1986 Wyluda ..... F42B 14/06 102/522
4,644,865 A * 2/1987 Lawrence ..... F42B 5/067 102/430
4,653,404 A * 3/1987 Halverson ..... F42B 14/068 102/520
4,671,182 A * 6/1987 Zierler ..... F42B 14/061 102/521
4,735,147 A * 4/1988 Halverson ..... F42B 14/064 102/520
4,850,280 A * 7/1989 Wallow ..... F42B 14/064 102/501
4,920,889 A * 5/1990 Luther ..... F42B 14/061 102/521

(Continued)

FOREIGN PATENT DOCUMENTS

DE 102010044003 A1 5/2012

*Primary Examiner* — Bret Hayes
*Assistant Examiner* — Derrick Morgan
(74) *Attorney, Agent, or Firm* — Michael J. Renner, Esq.; Luedeka Neely Group, P.C.

(57) ABSTRACT

A sabot assembly includes a projectile and a housing dimensioned and configured for receiving the projectile. An air pressure cavity having a cavity diameter is disposed between a front end and a rear end of the housing. Air intake nozzles are in fluid communication with the air pressure cavity and each has a nozzle diameter less than the cavity diameter. In operation, air flows through the plurality of air intake nozzles and into the air pressure cavity upon firing of the projectile from a gun barrel to pressurize the air pressure cavity for assisting in separation of the housing from the projectile upon the sabot assembly exiting the gun barrel.

21 Claims, 4 Drawing Sheets

(56) References Cited

U.S. PATENT DOCUMENTS 5,052,305 A * 10/1991 Chiarelli ..... F42B 14/064 102/522
5,277,121 A 1/1994 Campoli et al.
5,481,981 A * 1/1996 Sippel ..... F42B 14/064 102/522
5,513,571 A * 5/1996 Grantz ..... F42B 15/00 102/374
6,367,387 B1 * 4/2002 Kruper ..... F42B 14/064 102/439
7,331,294 B2 2/2008 Mank
8,424,457 B2 * 4/2013 Baumann ..... F42B 5/18 102/522
8,661,984 B2 3/2014 Minnicino, II
2002/0073871 A1 * 6/2002 Denis ..... F42B 30/02 102/439
2003/0167958 A1 * 9/2003 Johansson ..... F42B 14/068 102/522
2010/0000439 A1 * 1/2010 Baumann ..... F42B 14/064 102/521
2010/0139518 A1 * 6/2010 Baumann ..... F42B 14/065 102/523
2011/0197780 A1 * 8/2011 Heitmann ..... F42B 14/064 102/522
2013/0125774 A1 5/2013 Volkmann

* cited by examiner

SABOT ASSEMBLY

GOVERNMENT RIGHTS

The U.S. Government has rights to this invention pursuant to contract number DE-NA0001942 between the U.S. Department of Energy and Consolidated Nuclear Security, LLC.

FIELD

This disclosure relates to the field of ammunition for weapons systems. More particularly, this disclosure relates to a sabot for stabilizing a projectile fired from a gun barrel having a larger diameter than the projectile.

BACKGROUND

Sabot round assemblies generally include a projectile, which is typically a narrow metal rod with a pointed nose on its front end and stabilizing fins at its rear end, surrounded by a larger diameter sabot. Prior to firing the projectile, the rear part of the projectile is attached to a shell casing. Upon firing, the shell casing remains in the gun chamber and the propellant from the casing pushes the sabot assembly through the gun barrel. Once the sabot assembly exits the barrel, the sabot separates from the projectile. Because the gun barrel includes a larger diameter than the projectile, the sabot is needed to fill the void between the projectile and the gun barrel to, among other things, stabilize the projectile during firing and prevent the escape of gas from the shell casing ahead of the projectile.

Several problems exist with current sabot designs such as the requirement for precise machining (i.e., added expense) to make sure the diameter of the sabot assembly conforms to the diameter of the gun barrel. Additionally, current sabot designs typically include a front air scoop that essentially acts as a parachute to generate the force needed to separate the sabot from the projectile. This not only has the undesirable effect of slowing down the projectile, but it also tends to generate uneven forces on the sabot assembly resulting in trajectory degradation or failure for the projectile and damage to the gun barrel.

What is needed therefore is a sabot design capable of being efficiently manufactured while separating more efficiently from a projectile.

SUMMARY

According to one embodiment of the disclosure, a sabot assembly includes a housing having a front end and a rear end dimensioned and configured for receiving a projectile. An air pressure cavity having a cavity diameter is disposed within the housing between the front end and the rear end of the housing and around a portion of the projectile. A plurality of air intake nozzles are in fluid communication with the air pressure cavity and each has a nozzle diameter less than the cavity diameter. The plurality of air intake nozzles extend from the front end of the housing and in parallel with the projectile to the air pressure cavity. In operation, air flows through the plurality of air intake nozzles and into the air pressure cavity upon firing of the projectile from a gun barrel to pressurize the air pressure cavity, thereby causing expansion of the housing around the projectile and against the internal surface of the gun barrel, and also assisting in separation of the housing from the projectile upon the sabot assembly exiting the gun barrel.

According to certain embodiments, the housing is removeably secured to the projectile along a first connection area disposed between a front end of the air pressure cavity and the front end of the housing and along a second connection area disposed between a rear end of the air pressure cavity and the rear end of the housing. The housing may also be divided into a plurality of independent housing sections such that each housing section is separated from both the projectile and the other housing sections upon the sabot assembly exiting the gun barrel.

According to certain embodiments, the cavity diameter is substantially constant throughout the air pressure cavity. In other embodiments, the cavity diameter may be tapered such that the air pressure cavity includes a greater diameter at a first end of the cavity adjacent to the front end of the housing than at a second end of the cavity adjacent to the rear end of the housing.

According to certain embodiments, the housing includes one or more columnar supports traversing the air pressure cavity and dividing the air pressure cavity into at least two cavity sections.

In another embodiment of the disclosure, a sabot assembly includes a projectile and a housing dimensioned and configured for receiving the projectile. An air pressure cavity is disposed between a front end and a rear end of the housing and includes a cavity diameter. A plurality of air intake nozzles are in fluid communication with the air pressure cavity and each has a nozzle diameter less than the cavity diameter. The plurality of air intake nozzles extend from the front end of the housing to the air pressure cavity. In operation, air flows through the plurality of air intake nozzles and into the air pressure cavity upon firing of the projectile from a gun barrel to pressurize the air pressure cavity for assisting in separation of the housing from the projectile upon the sabot assembly exiting the gun barrel.

According to certain embodiments, the air pressure cavity is disposed adjacent the rear end of the housing and substantially behind the projectile.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred and other embodiments, reference is made to the accompanying drawings, which form a part hereof, and within which are shown by way of illustration the practice of specific embodiments of the disclosure. It is to be understood that other embodiments may be utilized, and that structural changes may be made and processes may vary in other embodiments.

Figure 1:
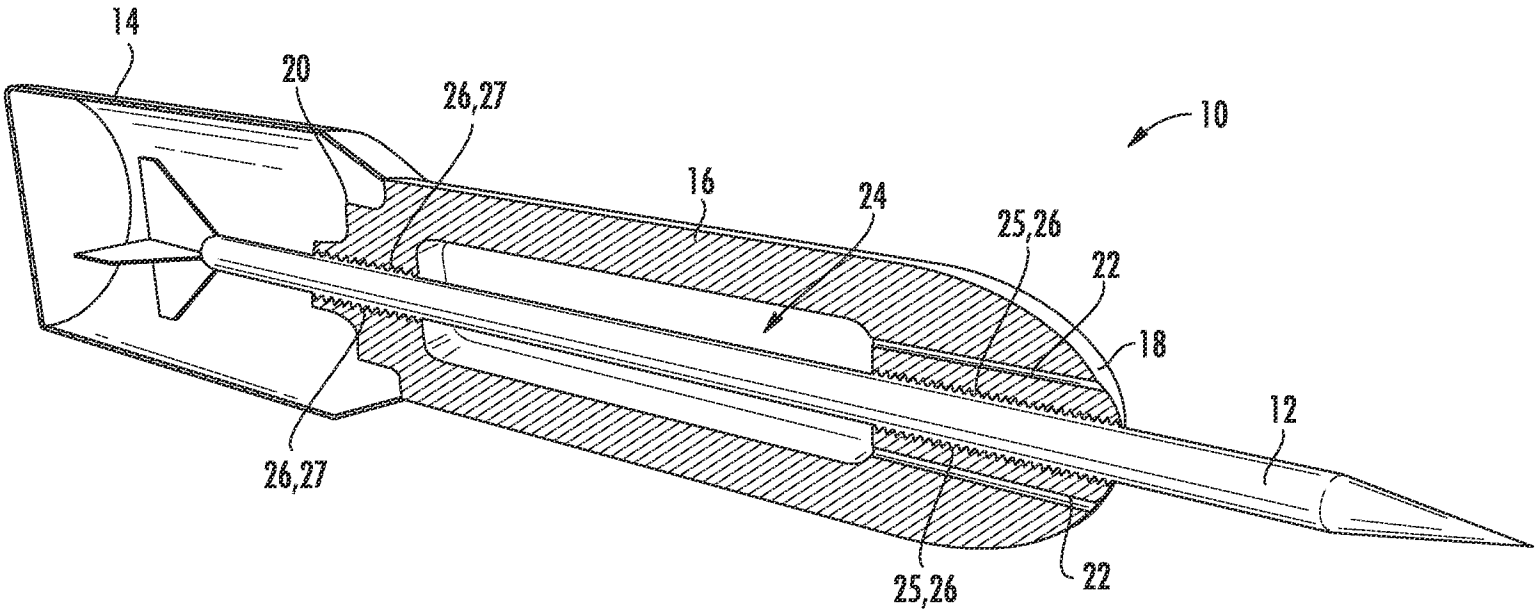
FIG. 1 depicts a cross-sectional view of a sabot assembly according to one embodiment of the present disclosure.
Figure 2:
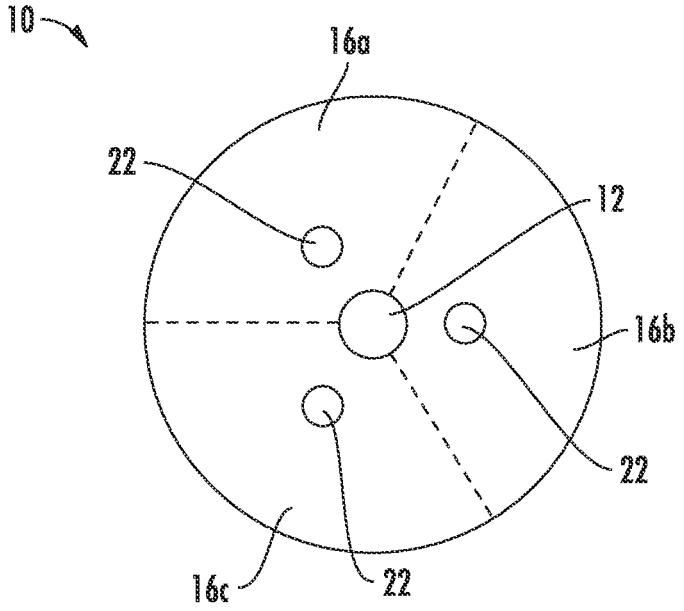
FIG. 2 depicts an overhead view of the sabot assembly of FIG. 1.

Referring to FIGS. 1-2, a sabot assembly 10 of the present disclosure includes a projectile 12 surrounded by a cylindrical sabot housing 16. The housing 16 is preferably constructed from a plastic composite material or fiber reinforced plastic composite material as known in the art. As shown in FIG. 1, the sabot housing includes a front end 18 and a rear end 20. The projectile 12 preferably extends beyond the front end 18 of the housing 16 towards a target as well as beyond the rear end 20 of the housing into a shell casing 14 containing propellant used to fire the sabot assembly 10. The cylindrical housing 16 includes a housing diameter that substantially conforms to the diameter of a gun barrel (not shown) from which the sabot assembly 10 is configured to be fired. In this regard, the sabot assembly 10 as shown and described herein is particularly suited for a standard sized gun barrel having a diameter of 120 mm from which sabot encapsulated projectiles are typically launched. However, it should be understood that the sabot assembly 10 of the present disclosure can be similarly configured and adapted for all different sizes and types of guns used to shoot various types of projectiles.

To assist in separating the sabot housing 16 from the projectile 12 after the sabot assembly 10 exits the gun barrel, the sabot housing 16 includes a plurality of air intake nozzles 22 in fluid communication with an air pressure cavity 24. As shown in FIG. 1, the air pressure cavity 24 is disposed between the front end 18 and rear end 20 of the housing 16 such that it surrounds a portion of the projectile 12. The air intake nozzles 22 extend from the front end 18 of the housing in parallel with the projectile 12 to the air pressure cavity 24. Thus, the air pressure cavity 24 is entirely surrounded by the housing 16 except for any openings allowing for airflow from the air nozzles 22. While the air pressure cavity 24 may be any desired shape, it is preferably cylindrical to match the shape of the cylindrical housing 16.

In preferred embodiments, the sabot housing 16 is removeably connected to the projectile 12 preferably using a tooth-threaded connection 26 as known in the art and exemplified in, for example, U.S. Pat. No. 3,620,167. It is noted that this tooth/groove connection, or any other type of connection that may otherwise be used, must be sufficient to keep the sabot housing 16 connected to the projectile while the assembly 10 is disposed in the sabot housing 16 despite the extreme g-forces acting upon the assembly, particularly towards the front end 18 of the housing 16, yet capable of smoothly and efficiently allowing the housing 16 to separate from the projectile 12 once the assembly 10 exits the barrel. Due to the air pressure cavity 24 surrounding a portion of the projectile 12, the housing 16 is removeably secured to the projectile 12 at a front connection area 25 adjacent to the front end 18 of the housing 16, and disposed circumferentially between the projectile 12 and air intake nozzles 22, and at a rear connection area 27 adjacent to the rear end 20 of the housing 16. It is noted that the length of the air intake nozzles 22 is at least in part dependent on the needed length of the front connection area 25. In preferred embodiments, the front connection area and resulting length of the air intake nozzles 22 is between about 50 mm and about 150 mm for an assembly configured for a 120 mm diameter gun barrel.

Referring to the overhead view of FIG. 2, from the perspective of looking down on the front end 18 of the housing 16, the sabot housing 16 is preferably provided with three air intake nozzles 22 each spaced equidistantly apart from the other air intake nozzles. Additionally, the housing 16 is separated into three independent sections 16*a*, 16*b*, and 16*c* each dimensioned substantially equal to the others and each including one of the air intake nozzles 22 such that each section is separated from both the projectile 12 and the other housing sections upon the sabot assembly 10 exiting the gun barrel. While three air intake nozzles 22 and three housing sections 16*a*, 16*b*, and 16*c* are shown in this embodiment, it should be understood that the assembly 10 could include any number of air intake nozzles 22 and/or independent housing sections as desired. In preferred embodiments, the independent housing sections are removeably connected to each other using a similar tooth-threaded connection used to connect the housing 16 to the projectile 12 as shown in FIG. 1.

In operation, air enters the air nozzles 22 upon firing of the projectile 12 from a gun barrel. The air travels through the air nozzles 22 to the air pressure cavity 24 resulting in equal pressure being applied to the immediate areas of the housing 16 surrounding the air pressure cavity. In other words, the assembly 10 uses the tremendous muzzle velocity upon firing of the projectile 12 to pressurize the air pressure cavity 24 via the air intake nozzles 22. In preferred embodiments, the pressurized cavity 24 causes the housing 16 to slightly expand and thereby push the sabot housing 16 against the projectile for greater stability and against the internal surface of the gun barrel. As noted above, in order for proper firing of the projectile 12, the sabot must form a tight seal between the gun barrel and the projectile. This generally requires very precise machining of the sabot to make sure it conforms to the diameter of the gun barrel. However, providing for expansion of the sabot housing 16 upon firing according to the present disclosure allows the sabot housing 16 to be fabricated with more relaxed tolerances and, thus, less expensively.

Once the projectile 12 and associated sabot housing 16 exit the gun barrel, the internal pressure in the pressure cavity 24 exceeds the air pressure external to the gun barrel and therefore operates to smoothly and efficiently separate the sabot housing 16 from the projectile 12 without subjecting the projectile 12 to unnecessarily high mechanical stresses. As noted above, the sabot housing 16 is preferably separated into multiple sections 16*a*, 16*b*, and 16*c* loosely attached to each other while the assembly 10 is inside the gun barrel. Upon exiting the gun barrel, the internal pressure of the pressure cavity 24 causes each section of the housing 16 to separate and push away from the projectile 12 and the other sections.

In another aspect of the disclosure, the internal pressure of the pressure cavity 24 may be altered in various ways. One way is by changing the diameter of the air intake nozzles 22. In this regard, an increase in the air intake nozzle diameter 22 increases the air pressure of the pressure cavity 24. In preferred embodiments, the diameter of the air nozzles remains in a range of about 2 mm to 4 mm for a 120 mm diameter gun barrel while the diameter of the pressure cavity is in a range of about 70 mm to about 90 mm. Another way to alter the internal pressure of the pressure cavity 24 is to alter the dimensions and configuration of the pressure cavity 24. For example, the front end 18 of the housing 16 generally requires a stronger connection (e.g., larger surface connection area) between the housing 16 and projectile 12 because it exits the gun barrel before the rear end of the housing. Thus, in certain embodiments, it may be advantageous to provide a stronger front connection area 25. As a result, it may be desired to apply a greater separation pressure toward the front end of the cavity 24. This may be accomplished by tapering the cavity 24 such that it includes a greater diameter towards the front of the cavity 24 and a smaller diameter towards the rear of the cavity.

Figure 3:
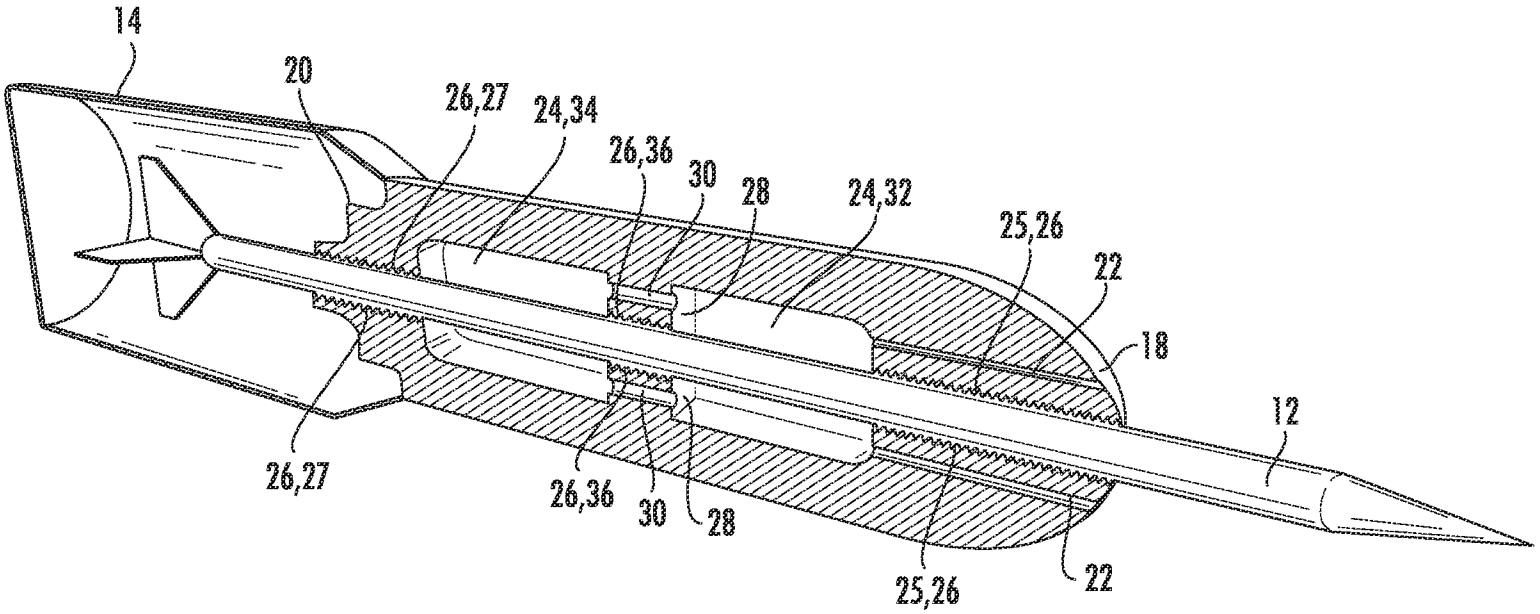
FIG. 3 depicts a cross-sectional view of a sabot assembly according to another embodiment of the present disclosure.

Referring to FIG. 3, an alternate embodiment of the sabot housing 16 is shown in which the housing 16 includes one or more columnar supports 28 traversing the air pressure cavity 24. The columnar supports 28 are used to provide additional support connection areas 36 in which to secure the housing 16 to the projectile 12. As shown, the columnar supports 28 include their own nozzles/apertures 30 so that air entering the air pressure cavity 24 through air intake nozzles 22 can flow past the columnar supports 28 to the rear of the cavity 24 through nozzles 30. As a result, the cavity 24 is effectively divided into separate sections 32 and 34. Similar to varying the diameter of the air intake nozzles 22 to alter the internal pressure of cavity 24 as described above, the diameter of the nozzles 30 may also be altered to alter the internal pressure of the rear cavity section 34. For example, air intake nozzles 22 may be provided with a greater diameter than nozzles 30 of the columnar support 28 which would result in the front cavity section 32 having a greater internal pressure than the rear cavity section 34. In certain embodiments, similar to the tapered cavity described above, it may be advantageous to configure the front cavity section 32 to have a greater volume and thus resulting greater internal pressure than the volume and internal pressure of rear cavity section 34.

Figure 4:
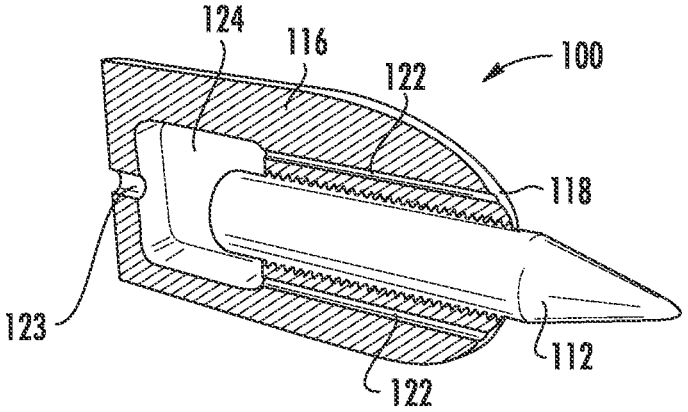
FIG. 4 depicts a cross-sectional view of a sabot assembly according to yet another embodiment of the present disclosure.

Referring to FIG. 4, an alternate embodiment of a "cup" type sabot assembly 100 is depicted for more circular (i.e., larger diameter in relation to length) projectiles 112. As shown, due to the more circular shape of the projectile 112, the air pressure cavity 124 is disposed primarily/substantially behind the projectile 112. In embodiments designed such that the sabot housing 116 remains inside the gun barrel after firing, the gun barrel is preferably configured to include a tapered opening or an opening otherwise dimensioned and configured to allow only the projectile 112 to travel through the opening while serving as a mechanical stop for the sabot housing 116. It is noted that other mechanical stops may also potentially be used such as a spring or chain attached to the rear of the sabot housing 116. In operation, the air travels through the air intake nozzles 122 to the air pressure cavity 124, which expands the sabot housing 116 to conform with the diameter of the gun barrel as described above. Additionally, the internal pressure in the pressure cavity 124 assists to smoothly and efficiently separate the sabot housing 116 from the projectile 112 once the sabot housing 116 hits its mechanical stop. A vacuum release nozzle 123 is preferably provided to allow air to be released from the air pressure cavity 124 . . . .

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A sabot assembly comprising:

a housing dimensioned and configured for receiving a projectile, the housing including a scoop-less front end having an outer surface and a rear end;

an air pressure cavity disposed between the front end and the rear end of the housing and around a portion of the projectile, the air pressure cavity including a cavity diameter; and a plurality of air intake nozzles in fluid communication with the air pressure cavity and each having a nozzle diameter less than the cavity diameter, the plurality of air intake nozzles extending from the outer surface of the front end of the housing to the air pressure cavity, wherein air flows through the plurality of air intake nozzles and into the aft pressure cavity upon firing of the projectile through a gun barrel to pressurize the air pressure cavity and cause expansion of the housing against an internal surface of the gun barrel.

2. The sabot assembly of claim 1 wherein the housing is removeably secured to the projectile.

3. The sabot assembly of claim 2 wherein the housing is removeably secured to the projectile along a first connection area disposed between a front end of the air pressure cavity and the front end of the housing and along a second connection area disposed between a rear end of the air pressure cavity and the rear end of the housing.

4. The sabot assembly of claim 1 wherein the cavity diameter is substantially constant throughout the air pressure cavity.

5. The sabot assembly of claim 1 wherein the cavity diameter is tapered such that the air pressure cavity includes a greater diameter at a first end of the cavity adjacent the front end of the housing than at a second end of the cavity adjacent the rear end of the housing.

6. The sabot assembly of claim 1 wherein the housing includes one or more columnar supports traversing the air pressure cavity and dividing the air pressure cavity into a front cavity section and one or more rear cavity sections.

7. The sabot assembly of claim 6 wherein the volume of the front cavity section is greater than the volume of the one or more rear cavity sections.

8. The sabot assembly of claim 1 wherein the plurality of air intake nozzles are each disposed equidistantly apart from adjacent air intake nozzles.

9. The sabot assembly of claim 1 wherein the housing is divided into a plurality of independent housing sections such that each housing section is separated from both the projectile and the other housing sections upon the sabot assembly exiting the gun barrel.

10. A sabot assembly comprising: a projectile; a housing dimensioned and configured for receiving the projectile, the housing including a scoop-less front end having an outer surface and a rear end; an air pressure cavity disposed between the front end and the rear end of the housing and around a portion of the projectile, the air pressure cavity including a cavity diameter; and a plurality of air intake nozzles in fluid communication with the air pressure cavity and each having a nozzle diameter less than the cavity diameter, the plurality of air intake nozzles extending from the outer surface of the front end of the housing to the air pressure cavity, wherein air flows through the plurality of air intake nozzles and into the air pressure cavity upon firing of the projectile through a gun barrel to pressurize the air pressure cavity and cause expansion of the housing against an internal surface of the gun barrel.

11. The sabot assembly of claim 10 wherein the housing is removeably secured to the projectile.

12. The sabot assembly of claim 11 wherein the housing is removeably secured to the projectile along a first connection area disposed between a front end of the air pressure cavity and the front end of the housing and along a second connection area disposed between a rear end of the air pressure cavity and the rear end of the housing.

13. The sabot assembly of claim 10 wherein the cavity diameter is substantially constant throughout the air pressure cavity.

14. The sabot assembly of claim 10 wherein the cavity diameter is tapered such that the air pressure cavity includes a greater diameter at a first end of the cavity adjacent the front end of the housing than at a second end of the cavity adjacent the rear end of the housing.

15. The sabot assembly of claim 10 wherein the housing includes one or more columnar supports traversing the air pressure cavity and dividing the air pressure cavity into a front cavity section and one or more rear cavity sections.

16. The sabot assembly of claim 15 wherein the volume of the front cavity section is greater than the volume of the one or more rear cavity sections.

17. The sabot assembly of claim 10 wherein the plurality of air intake nozzles are each disposed equidistantly apart from adjacent air intake nozzles.

18. The sabot assembly of claim 10 wherein the housing is divided into a plurality of independent housing sections such that each housing section is separated from both the projectile and the other housing sections upon the sabot assembly exiting the gun barrel.

19. The sabot assembly of claim 10 wherein the air pressure cavity is disposed adjacent the rear end of the housing and substantially behind the projectile.

20. The sabot assembly of claim 10 wherein the plurality of air intake nozzles extend from the outer surface of the front end of the housing in parallel with the projectile to the air pressure cavity.

21. The sabot assembly of claim 1 wherein the plurality of air intake nozzles extend from the outer surface of the front end of the housing in parallel with the projectile to the air pressure cavity.

* * * * *